United States Patent [19]

Crossot

[11] 4,277,903

[45] Jul. 14, 1981

[54] FRAMING AND HANGING ASSEMBLY FOR A SHEET MATERIAL OBJECT

[76] Inventor: Eugene A. Crossot, 1829 E. Lake Bluff Blvd., Milwaukee, Wis. 53211

[21] Appl. No.: 967,622

[22] Filed: Dec. 8, 1978

[51] Int. Cl.[3] ..... G09F 1/12

[52] U.S. Cl. ..... 40/152.1

[58] Field of Search ..... 248/489; 40/152.1, 155, 40/617

[56] References Cited

U.S. PATENT DOCUMENTS

| | | | |
|---|---|---|---|
| 1,481,120 | 1/1924 | Brombosz | 40/155 |
| 1,881,736 | 10/1932 | Lichter | 40/617 |
| 2,299,443 | 10/1942 | Waimsley | 40/152.1 X |
| 2,779,118 | 1/1957 | Gundlach et al. | 40/617 X |
| 2,986,282 | 5/1961 | Brink | 40/152.1 X |
| 3,350,045 | 10/1967 | Mayers | 248/205 |
| 3,552,708 | 1/1971 | Hillstrom | 248/489 |
| 3,665,628 | 5/1972 | Dammond | 40/155 |
| 3,867,774 | 2/1975 | Kise | 40/155 |
| 3,946,511 | 3/1976 | Wiener | 40/152.1 |

*Primary Examiner*—Gene Mancene
*Assistant Examiner*—Wenceslao J. Contreras
*Attorney, Agent, or Firm*—Andrus, Sceales, Starke & Sawall

[57] ABSTRACT

An assembly for framing and hanging a sheet material object for wall display includes a framing member for engaging the upper edge of the object. As viewed in section, the framing member comprises a U-shaped member having opposed forwardly and rearwardly disposed yieldable fingers biased into abutting relation to receive and grasp the sheet material object therebetween. A clip is engageable with the rearwardly disposed finger of the framing member and is slidable relative thereto to provide for centering of the clip relative to the framed object and includes means for supporting the framed object from hanger means on the display wall.

2 Claims, 3 Drawing Figures

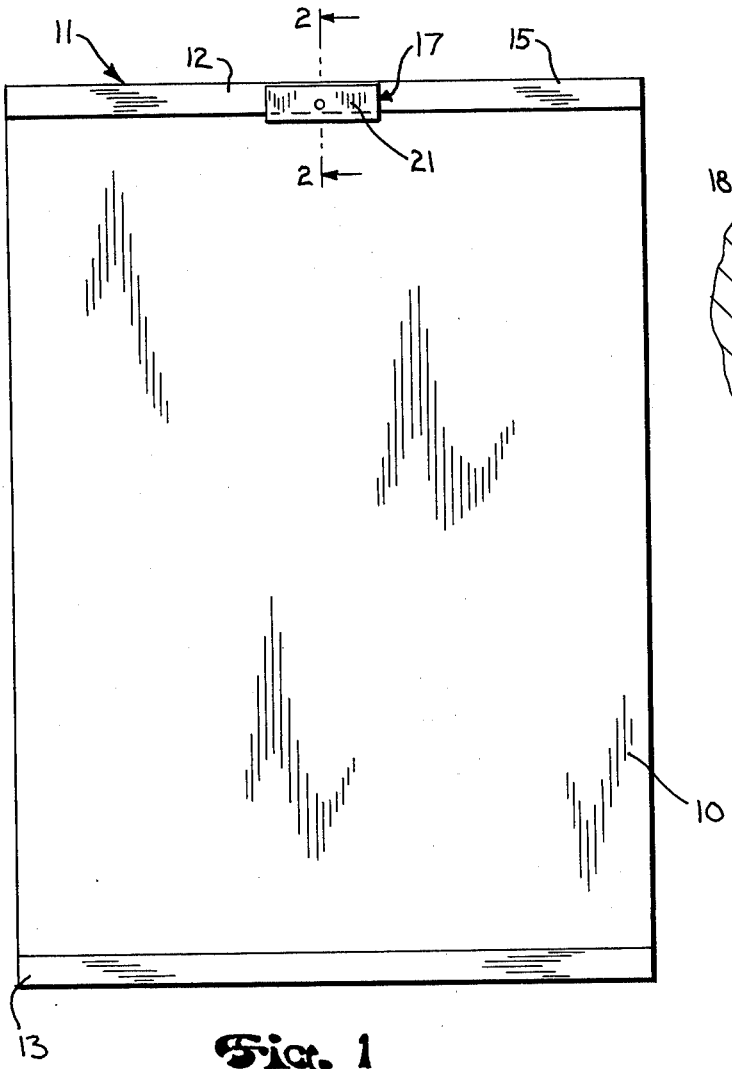
Fig. 1
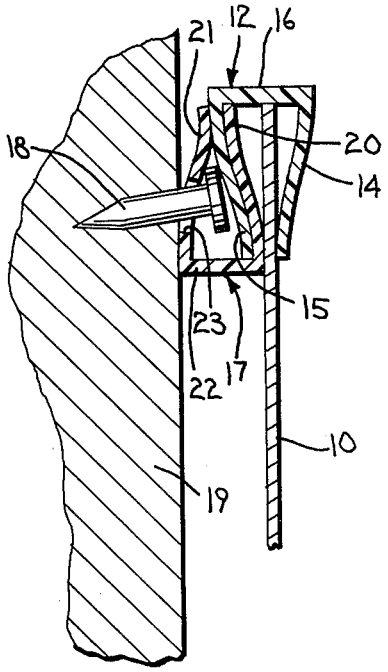
Fig. 2
Fig. 3
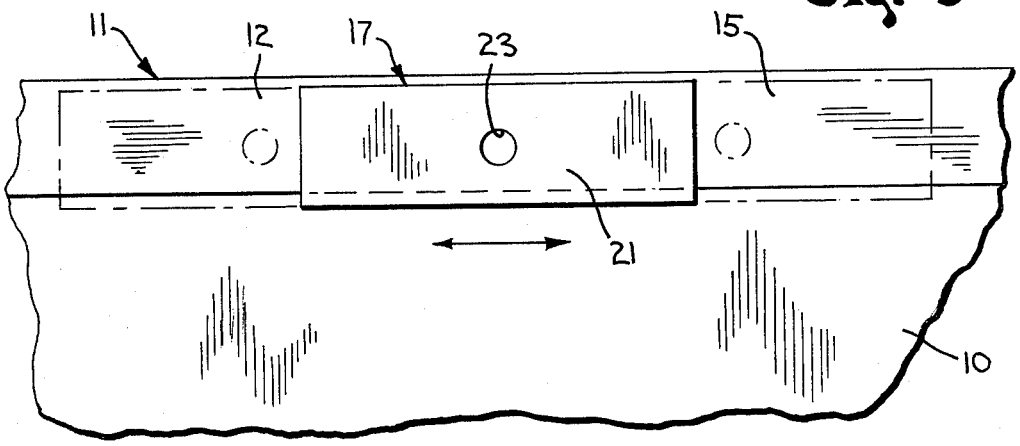

FRAMING AND HANGING ASSEMBLY FOR A SHEET MATERIAL OBJECT

BACKGROUND OF THE INVENTION

This invention relates to the framing and hanging of posters, calendars, pennants, charts and other generally light weight sheet material objects for wall display.

Sheet material objects for wall display are often hung by means of string, tacks or tape. Such means are generally unsightly and detract from the display items. When hung by such means, the display items are frequently torn or otherwise mutilated if accidently bumped or disturbed by stiff breezes to render the display items short-lived. It is generally an object of this invention to provide a framing and hanging assembly for sheet material objects which assembly is relatively inexpensive and yet attractive, easily assembled, will not ordinarily contribute to the mutilation of the display items, and will not unduly mar the display wall.

SUMMARY OF THE INVENTION

Generally the invention is directed to an assembly for at least partially framing and thereafter hanging a sheet material object for wall display. The assembly generally includes a framing member for engaging the upper edge of the object. As viewed in section, the framing member comprises a U-shaped member having opposed forwardly and rearwardly disposed yieldable fingers biased into abutting relation to receive and grasp the object therebetween. A clip is engageable with the rearwardly disposed finger of the framing member and is slidable relative to the member to provide for centering of the clip relative to the framed object. The clip is provided with means for supporting the framed object from hanger means on the display wall.

DESCRIPTION OF THE DRAWING FIGURES

The drawings furnished herewith illustrate the best mode presently contemplated for the invention and are described hereinafter.

In the drawings:

FIG. 1 is a rear view of a partially framed sheet material object with a clip assembled to the upper frame member in accordance with the invention;

FIG. 2 is a sectional view taken generally on the line 2—2 and further shows the framed object as hung on the display wall; and FIG. 3 is an enlarged rear detail view and illustrates how the clip is slidable longitudinally relative to the framing member to provide for centering of the clip relative to the framed object.

DESCRIPTION OF THE ILLUSTRATED EMBODIMENT

Referring to the drawings, a sheet material object 10 for wall display is provided with at least a partial framing border 11. While the sheet material object 10 might have been provided with a full peripheral border if desired, only a top border strip 12 and bottom border strip 13 are shown. The border strips 12 and 13 preferably extend the full width of the sheet material object 10 to minimize possible side curl which would detract from the display. The bottom border strip 13 adds an increment of weight to the sheet material object 10 to minimize possible bottom curl. If the sheet material object 10 will readily hang flat, even the bottom border strip 13 may prove unnecessary.

The individual border strips 12 and 13 making up the framing border 11 comprise one-piece U-section gripping members for receiving and holding onto the corresponding edge of the sheet material object 10. In section, each gripping member or strip appears as a pair of opposed fingers 14 and 15 extending from a connecting web portion 16. The opposed fingers 14 and 15 are yieldable to receive the sheet material object 10 therebetween and biased against each other remote from the portion 16 to hold or retain the same.

The gripping members or strips 12 and 13 are made of a suitable plastic and can be formed by an extrusion process. While the members or strips may be made available to users in one or more given lengths, they are readily cut to the desired dimension for use in a specific application.

The poster, pennant, chart or other sheet material object 10 outfitted with a framing border 11 for wall display is supported by means of a single clip 17 from a projecting member such as a pin, nail or other hanger 18 secured to the wall 19. The clip 17 is relatively short and comprises a U-section gripping member having a pair of opposed fingers 20 and 21 extending from the connecting web portion 22 when viewed in section. The clip 17 may be made of the same material and have a section generally identical to that of the border strips 12 and 13.

While the top border strip 12 appears as an inverted U-shaped member for support of the sheet material object 10 as best shown in FIG. 2, the U-section clip 17 is disposed oppositely. In assembled relation, the forwardly disposed finger 20 of the clip 17 is inserted and grippingly received between the fingers 14 and 15 of the strip 12. The assembly provides that the rearwardly disposed finger 15 of the strip 12 will be grippingly received between the fingers 20 and 21 of the clip 17. If the section of strip 12 and of the clip 17 are generally identical, the respective inserted fingers 15 and 20 of the assembly will generally reach to the corresponding web portions 16 and 22 of the opposite member. In the assembly, the added thickness of the clip finger 20 between the border strip fingers 14 and 15 substantially enhances the gripping action of the latter on the sheet material object 10.

While the gripping action of the fingers 14 and 15 of the top border strip 12 on the clip 17 and of the fingers 20 and 21 of the clip on the top border strip is generally adequate to provide that the assembly will be retained in desired relation, the clip is manually slideable longitudinally relative to the framing member as generally illustrated in FIG. 3 to provide for centering of the clip and proper hanging of the poster, pennant, chart or other sheet material 10.

The pin, nail or other hanger 18 is anchored relative to the wall 19 at the site for hanging the sheet material object 10. To effect the hanging, the rearwardly disposed finger 21 of the clip 17 is provided with a hole 23 generally centrally thereof for receiving the projecting end of the wall mounted pin, nail or other hanger 18.

In practice, the framing border 11 comprising at least the top border strip 12 is assembled onto the poster, pennant, chart or other sheet material 10 for wall display. Thereafter, the clip 17 is assembled to the top border strip 12 and approximately centered by eye relative to the assembly. If upon hanging, the sheet material 10 appears askew and therefore off center, the clip 17 is slidably moved relative to the top border strip 12 until a centered appearance is attained.

The framing and clip assembly of this invention can be fabricated relatively inexpensively in a variety of attractive colors to provide for attractive wall display of posters, pennants, calendars, charts and other light weight sheet material items. If the framed item is somehow disturbed and rendered askew, recentering of the clip for proper hanging is readily effected. Since the sheet material item for wall display is neither punctured or adhesively engaged by the assembly of this invention, it can remain available as an attractive display for a relatively long period. The wall, too, requires but a single hanger and is not further marred by tack punctures or tape residue.

Various modes of carrying out the invention are contemplated as being within the scope of the following claims particularly pointing out and distinctly claiming the subject matter which is regarded as the invention.

I claim:

1. In an assembly for at least partially framing and thereafter hanging a sheet material object for wall display, a framing member for engaging the upper edge of the object, said framing member comprising a U-section member having opposed forwardly and rearwardly disposed yieldable fingers biased into abutting relation to receive, grasp and retain said object therebetween, and a clip comprising a U-section member having opposed forwardly and rearwardly disposed yieldable fingers biased into abutting relation and having a cross section generally dimensionally identical to that of the framing member, said U-section clip member being oppositely oriented from the U-section framing member such that upon assembly the rearwardly disposed finger of the framing member is received and retained between the fingers of the clip and the forwardly disposed finger of the clip is received and retained between the fingers of the framing member, said forwardly disposed finger of the clip further serving to enhance the retaining pressure of the framing member on the sheet material object, said clip being slidable longitudinally relative to said framing member to provide for centering of the clip relative to the framed object and including means for supporting the framed object from hanger means on the display wall.

2. The structure as set forth in claim 1 wherein the rearwardly disposed finger of the U-section clip is provided with a longitudinally centered opening for receiving the hanger means on the display wall.

* * * * *